US008637165B2

(12) United States Patent
Siahaan et al.

(10) Patent No.: US 8,637,165 B2
(45) Date of Patent: Jan. 28, 2014

(54) CONNECTOR WITH MULTI-LAYER NI UNDERPLATED CONTACTS

(75) Inventors: Edward Siahaan, San Francisco, CA (US); John B. Ardisana, II, San Francisco, CA (US); Mathias Schmidt, San Francisco, CA (US); Jason Sloey, San Jose, CA (US); Albert J. Golko, Saratoga, CA (US); Eric Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 231 days.

(21) Appl. No.: 13/250,920

(22) Filed: Sep. 30, 2011

(65) Prior Publication Data

US 2013/0084760 A1 Apr. 4, 2013

(51) Int. Cl.
*H01R 13/03* (2006.01)

(52) U.S. Cl.
USPC ..... 428/675; 428/680; 428/935; 428/929; 428/672; 439/886; 439/887; 200/269

(58) Field of Classification Search
None
See application file for complete search history.

(56) References Cited

U.S. PATENT DOCUMENTS

| | | | | | |
|---|---|---|---|---|---|
| 3,090,733 | A | * | 5/1963 | Brown | 428/639 |
| 3,288,574 | A | * | 11/1966 | Du Rose et al. | 428/639 |
| 3,354,059 | A | | 11/1967 | Koretzky | |
| 3,355,267 | A | * | 11/1967 | Du Rose | 428/639 |
| 3,367,854 | A | * | 2/1968 | Passal | 205/274 |
| 3,528,894 | A | * | 9/1970 | McMullen et al. | 205/178 |
| 3,806,429 | A | | 4/1974 | Clauss et al. | |
| 3,812,566 | A | | 5/1974 | Clauss | |
| 3,878,067 | A | | 4/1975 | Tremmel | |
| 3,974,044 | A | | 8/1976 | Tremmel | |
| 3,994,694 | A | | 11/1976 | Clauss et al. | |
| 4,002,543 | A | | 1/1977 | Clauss et al. | |
| 4,069,370 | A | | 1/1978 | Harmsen et al. | |
| 4,089,754 | A | | 5/1978 | Tremmel et al. | |
| 4,179,343 | A | | 12/1979 | Tremmel | |
| 4,339,644 | A | | 7/1982 | Aldinger et al. | |
| 4,891,480 | A | * | 1/1990 | Holden et al. | 200/262 |
| 5,108,317 | A | | 4/1992 | Beinhaur et al. | |
| 5,980,324 | A | | 11/1999 | Berg et al. | |
| 2002/0187688 | A1 | | 12/2002 | Marvin et al. | |
| 2004/0238338 | A1 | | 12/2004 | Ganz et al. | |
| 2005/0196634 | A1 | * | 9/2005 | Abe et al. | 428/615 |
| 2009/0317556 | A1 | * | 12/2009 | Macary | 427/438 |

FOREIGN PATENT DOCUMENTS

| | | | | |
|---|---|---|---|---|
| DE | 4013627 | A1 | | 10/1991 |
| DE | 19809961 | A1 | | 9/1999 |
| JP | 55-108757 | | * | 8/1980 |
| JP | 55119142 | A | | 9/1980 |

(Continued)

OTHER PUBLICATIONS

Partial International Search Report for International PCT Application No. PCT/US2013/035840, mailed on Sep. 24, 2013, 7 pages.

*Primary Examiner* — John J Zimmerman
(74) *Attorney, Agent, or Firm* — Kilpatrick, Townsend & Stockton LLP

(57) ABSTRACT

A corrosion-resistant electrical connector is disclosed. A multi-layer nickel underplating is applied to the substrate material of the connector contacts. The three layers of nickel include a leveling nickel layer, a sulfumate nickel layer, and a high-phosphorous nickel layer. A layer of gold is applied to the nickel underplating in an embodiment.

7 Claims, 5 Drawing Sheets

(56) References Cited

FOREIGN PATENT DOCUMENTS

| | | | | |
|---|---|---|---|---|
| JP | 1-109756 | * | | 4/1989 |
| JP | 4-255259 | * | | 9/1992 |
| JP | H08298038 | A | | 11/1996 |
| JP | 2010044983 | A | | 2/2010 |

* cited by examiner

CONNECTOR WITH MULTI-LAYER NI UNDERPLATED CONTACTS

FIELD OF THE INVENTION

The present invention relates generally to electrical connectors and in particular to plated electrical connector contacts.

BACKGROUND OF THE INVENTION

A wide variety of devices are available for consumers today. Many of these devices have connectors that that facilitate communication with and/or charging of the corresponding device. These connectors often interface with other connectors on cables that are used to connect devices to one another. Sometimes, connectors are used without a cable to directly connect the device to another device, such as a charging station or a sound system.

As smart-phones, media players, health monitoring devices and other electronic devices become increasingly prevalent, consumers become more reliant on the connectors and cables required to connect these devices to other computing devices and electrical outlets. The devices, and therefore the connectors for the devices and their corresponding cables, remain with consumers throughout the day as they travel in and out of fitness centers, kitchens, offices, factories, automobiles, and many other places.

Many of these locations provide opportunities for exposure to chemicals that pose little or no risk to the consumer, but present a harsh environment for contacts on traditional electrical connectors. For example, connectors regularly come into contact with food, sweat, and other elements that corrode the materials that make up the connector contacts. For example, a cable may even be plugged into an electrical outlet while the connector at the other end is exposed to harsh chemicals, such as a spilled soda, resulting in even greater corrosion.

Contacts are made primarily of copper alloys, due to their advantageous electrical properties. However, copper alloys are also highly susceptible to corrosion. Because of this, contacts are often covered with a sulfumate nickel underplate. As used herein, sulfumate nickel means any nickel that contains at least 98% nickel sulfumate $Ni(NH_2SO_3)_2$. The nickel underplate acts as a corrosion barrier and a wear barrier, because it is less corrosive and harder than the copper alloy that it covers. A gold layer is often placed on the outer layer in order to decrease contact resistivity. Diffusion of ions between the gold layer and the copper results in additional corrosion. The nickel underplate acts as a diffusion barrier, preventing the diffusion of gold ions from the outer gold layer into the copper alloy and vice versa. But nickel has inherent porosity. The thicker the nickel plating, the more likely pores will be created that can form a channel from the gold layer all the way to the copper alloy. Therefore, porosity defeats the diffusion resistance properties of nickel, because the channels formed between the gold layer and the copper alloy allow for the travel of ions between these layers.

The traditional contacts described above regularly survive industry standard tests for corrosion susceptibility, but these tests are directed to exposure to gases that encourage corrosion, and not the harsher chemicals described above. When consumer electronics and other electronic products are returned because of connector failures, it is common to see corrosion that can only be explained by exposure to food, sweat, or other chemicals that have a corrosive effect on connectors, but fall outside of the industry standard tests. In order to provide connectors that perform well in a typical environment in which consumer electronics are used, protection of the connectors from the chemicals found in these environments is desirable.

BRIEF SUMMARY OF THE INVENTION

Embodiments relate to the use of a multi-layer nickel underplate on a contact for an electronic connector. According to one aspect, the multi-layer nickel underplate comprises a leveling nickel layer that is applied to a substrate material on the connector, such as copper. A layer of sulfumate nickel is formed over the leveling nickel, and a layer of high-phosphorous nickel is formed over the sulfumate nickel.

In one embodiment the multi-layer underplate consists of three layers where the sulfumate nickel layer is formed directly on the leveling nickel layer and the high-phosphorous nickel is formed directly on the sulfumate nickel layer. In an embodiment, a gold-plating is applied to the high-phosphorous nickel plating. In an embodiment, the multi-layer nickel underplate is applied to only a portion of the contact. The multi-layer nickel underplate is applied to the entire surface area of the contact in an embodiment.

In an embodiment, the thickness of the leveling nickel plating is between 10 and 150 microinches, the thickness of the sulfumate nickel plating is between 10 and 150 microinches, and the thickness of the high-phosphorous nickel plating is between 10 and 100 microinches. In one embodiment, the combined thickness of the multi-layer underplate is between 30 and 180 microinches. In an embodiment, the thickness of the sulfumate nickel layer is dependent on the thickness of the leveling nickel layer. For example, the sulfumate nickel layer may have a thickness that is between 80% to 120% of the thickness of the leveling nickel layer. In an embodiment, the thickness of the high-phosphorous nickel layer is dependent on the thickness of the leveling nickel layer and/or the sulfumate nickel layer. For example, the high-phosphorous nickel layer may have a thickness that is between 25% to 100% of the thickness of the sulfumate nickel layer.

According to another aspect, leveling nickel plating is applied using an electroplating solution comprising: between 20-40 oz/gal Nickel sulphate, NiSO46H2O; between 4-20 oz/gal Nickel chloride, NiCl26H2O; and between 4-7 oz/gal Boric acid, H3BO3. In an embodiment, the electroplating solution further comprises between 0.1-3 oz/gal of one or both of paratoluene sulfonamide and benzene sulphonic acid. In an embodiment, the electroplating solution further comprises between 0.0006-0.02 oz/gal of formaldehyde chloral hydrate and/or allyl sulfonic acid. In an embodiment, the electroplating solution comprises between 0.01-0.5 oz/gal of one or both of the group comprising: sodium allyl sulfonate and pyridinum propyl sulfonate.

According to another aspect, the roughness of the substrate is greater than the roughness of the leveling nickel surface.

DETAILED DESCRIPTION OF THE INVENTION

Figure 1:
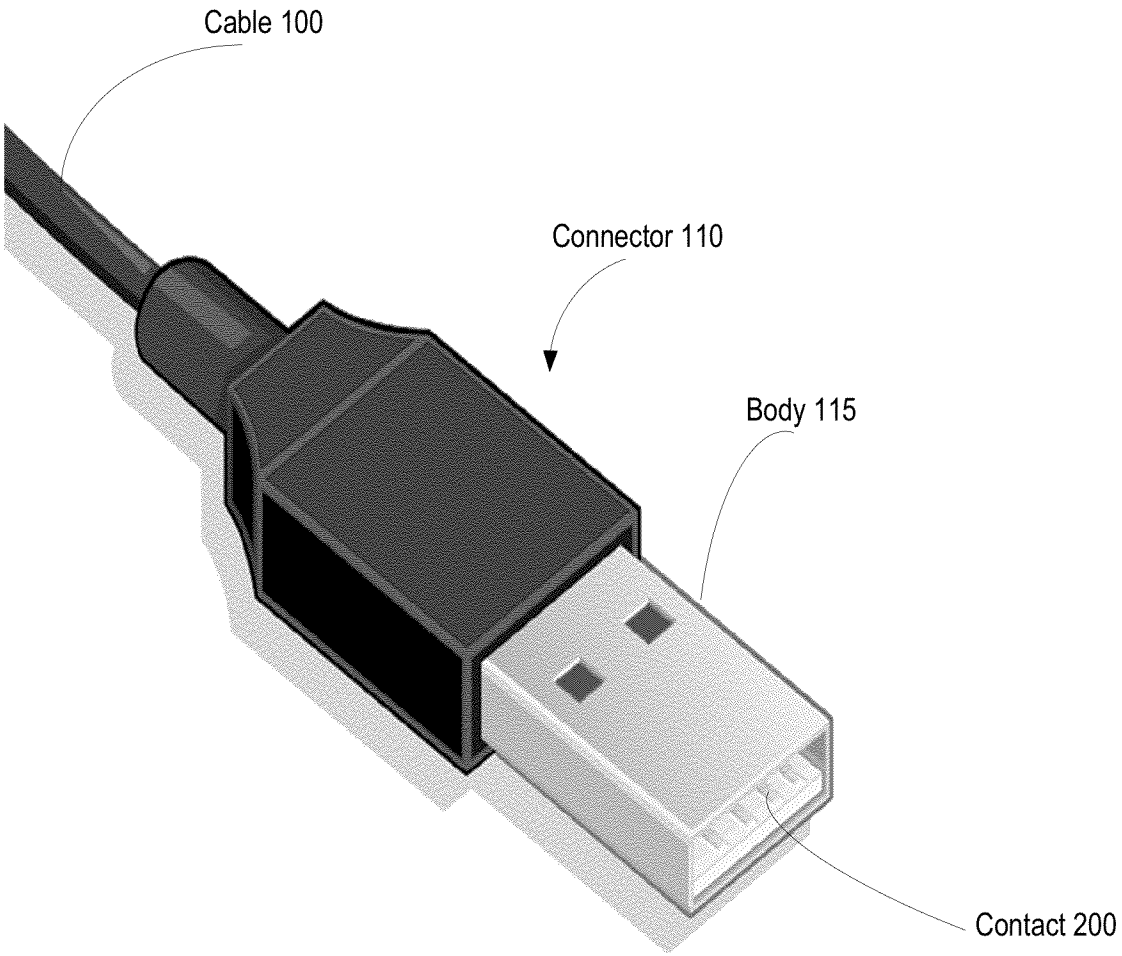
FIG. 1 is a diagram that illustrates an example of a cable on which a connector contact may be implemented according to an embodiment.
Figure 2:
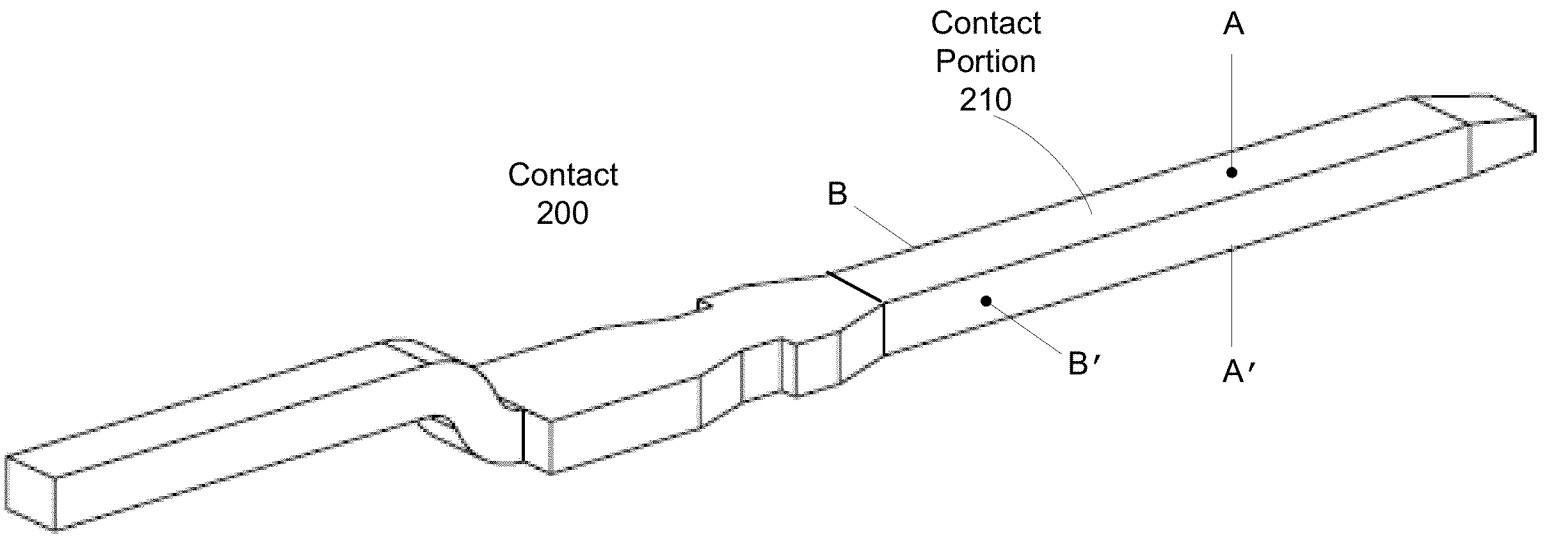
FIG. 2 is a diagram that illustrates an example contact having a contact portion on which an embodiment may be implemented.

Many electronic devices such as smart-phones, media players, and tablet computers have corresponding cables that facilitate battery charging and communication with other devices. FIG. 1 illustrates cable 100, which is a USB (Universal Serial Bus) cable. Cable 100 includes a connector 110 having a body 115 and a plurality of contacts such as contact 200 carried by the body. FIG. 2 illustrates an example of contact 200 in greater detail according to an embodiment of the invention.

Contacts are designed to interface with other contacts when the connector is attached to another device. For example, when connector 110 is plugged into a USB "port," the contacts for the USB port become coupled to the contacts for cable 100. This coupling effect allows electrical signals used for communication and electricity used for charging a device coupled to the other end of cable 100. Although USB connectors are discussed herein to illustrate one possible embodiment, other embodiments may be implemented on different types of connectors, such as fire wire connectors, thunderbird connectors, and other connectors for multimedia devices, computers, and smart-phones.

The portion of contact 200 that is designed to be coupled with a contact that is part of another connector or port is referred to herein as the "contact portion" 210. Nickel plating of the contact portion is often used as part of the preparation process, in order to provide corrosion resistance and durability. Electroplating is a widely used method of nickel plating. Nickel electroplating is performed by immersing the contact into an electrolyte solution. The contact is used as a cathode, and when the nickel anode is being dissolved into the electrolyte, nickel ions traveling through the solution are deposited on the surface of the contact.

In an embodiment, a multi-layer nickel underplate is deposited on connector contacts using electroplating techniques. In another embodiment, electroless nickel plating techniques may be used to apply the multi-layer nickel underplate.

Example Contact

Referring to FIG. 2, contact 200 generally represents an example contact that may be part of an electrical connector in an embodiment. Cross-section A-A' is perpendicular to contact portion 210. Cross-section B-B' is taken through the middle of contact 200, parallel to the surface of contact portion 210. Cross-section B-B' may be plated with different materials or different amounts of the same material than cross-section A 220. For example, cross-section B-B' may not be plated with the multi-layer nickel undercoating. Instead, cross-section B-B' may be coated with a single layer of corrosion-resistant conductive material.

Figure 3:
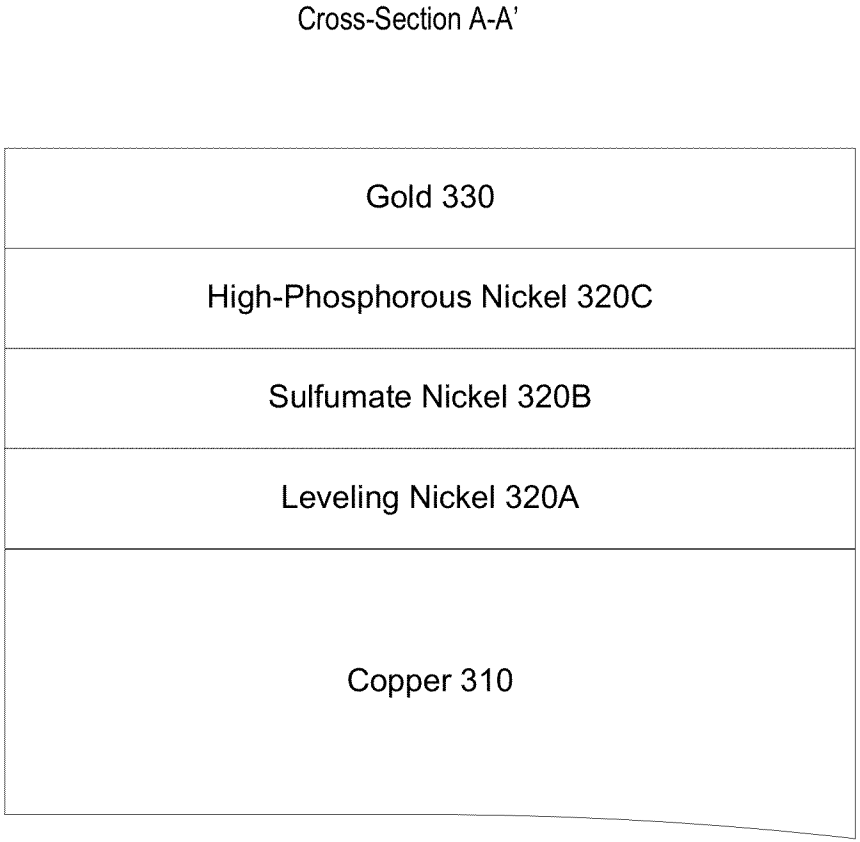
FIG. 3 is a diagram that illustrates a cross-section of a contact, the illustration identifying layers of materials that may be used in an embodiment.

Referring to FIG. 3, cross-section A-A' is illustrated with exaggerated layers for convenience. Contact 200 comprises an electrically conductive substrate, which in one embodiment is copper 310. In another embodiment, the electrically conductive substrate is aluminum. A multi-layer undercoating 320A-C is applied to the copper substrate 310, and a corrosion resistant electrically conductive coating is formed over the multi-layer underplating 320A-C. In one embodiment, corrosion resistant electrically conductive coating is gold 330. In another embodiment, silver, palladium, or a noble metal other than gold 330 is the corrosion resistant electrically conductive coating. In one embodiment, the multi-layer underplating 320A-C comprises a first layer 320A of leveling nickel, a second layer 320B of sulfumate nickel, and a third layer 320C is made up of high-phosphorous nickel in an embodiment.

In an embodiment, leveling nickel layer 320A is not applied directly to the substrate, but is applied to a conductive material that is first applied to the substrate. For example, a layer of high-phosphorous nickel or another type of nickel may be applied to the substrate before the application of the leveling nickel layer 320A. The other type of nickel may even be second type of leveling nickel, for a two-layer leveling combination. In an embodiment, conductive material may be applied between layers 320A and 320B, and/or between layers 320B and 320C.

Multi-layer Underplate

The first layer, or leveling nickel layer 320A of the underplate is made up of 40 micro-inches of leveling nickel in an embodiment. In other embodiments, the leveling nickel layer ranges from 10 to 150 microinches. As used herein, "leveling nickel" means any nickel that includes one or more additives that increase the leveling characteristics of nickel. Leveling nickel reduces porosity and creates level and smooth surfaces. Leveling nickel is applied to the substrate material, which may be a copper alloy.

Because electrical current tends to be attracted to the peaks of materials, plating materials also tend to be attracted to peaks in the substrate material during the electroplating process. This results in the build-up of plating materials on the peaks of the substrate material, creating a rough surface. When nickel with increased leveling characteristics is applied to a substrate using an electroplating technique, the nickel displays an increased attraction to the valleys in the substrate, creating a leveling effect by filling in the valleys instead of building up the peaks of the substrate. Leveling nickel includes high-leveling nickel, which is commonly used for decorative purposes due to the brightening effect resulting from the level distribution of nickel during the plating process.

Leveling nickel also includes any nickel which, when applied to a material, causes the resulting surface to be smoother than the surface of the material to which the nickel was applied. For example, optical measurement methods such as interference, path length, optical penetration, or resolution of focus may be used to measure roughness. A low coherence interferometer may be used to split a beam of light in the infrared range into two separate beams. One beam is directed at the surface and the other is directed at a mirror in the inferometer's reference arm. The probe receives and recombines the reflected light from the sample and reference arms and records the resulting interference. Based on this, the inferometer can determine the surface shape, roughness and waviness.

Figure 4:
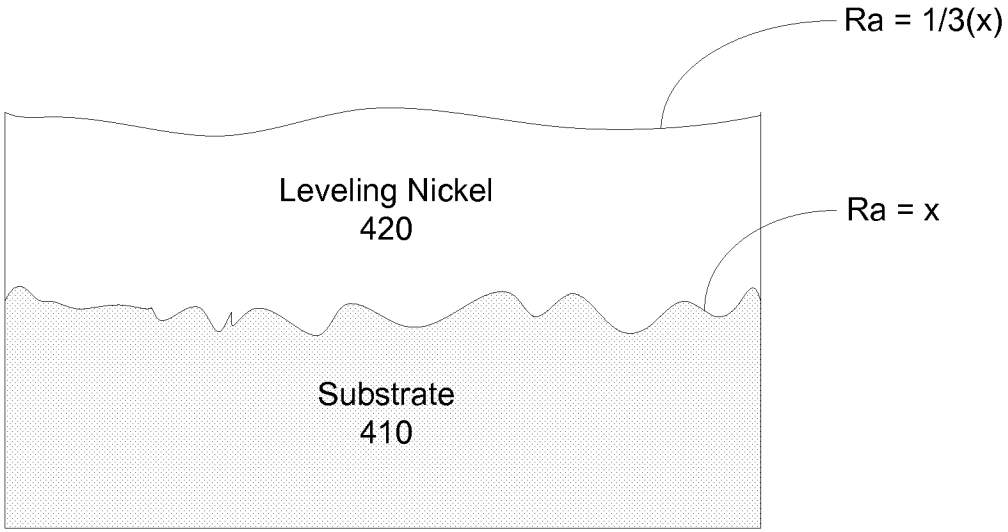
FIG. 4 is a diagram that illustrates the leveling effects of leveling nickel on a substrate in an embodiment.

FIG. 4 is a diagram that illustrates the leveling effects of leveling nickel on a substrate in an embodiment. A typical parameter that has been used to quantify the quality of a surface topography is the surface roughness, which is represented by the arithmetic mean value, Ra. A substrate 410, such as copper, may have a roughness of Ra=x, as measured by an inferometer or other device. By applying a layer of leveling nickel, the roughness of the resulting surface will be reduced to ⅓ x in an embodiment. When leveling nickel 420 is applied to a copper substrate 410, the resulting surface roughness can range from ½(x) to 1/50(x), where x is the roughness of the surface area of the copper substrate 410.

The additives used to achieve the leveling effect in leveling nickel are sometimes referred to as brightening agents or complexing agents. These additives may include ascorbic acid, isoascorbic acid, citrate, gluconate, tartrate, sulfo-oxygen, and other organic additives and brightening agents used to increase the brightness and leveling effects of nickel used for electroplating. These additives may also include secondary brighteners that work synergistically with other additives. Secondary additives may include 2-butyne-1,4-diol, the general class of acetylenic alcohols, or coumarins. Although specific additives have been discussed herein, nickel that includes any additive that increases the leveling characteristics of nickel is considered leveling nickel, and may be used in an embodiment.

Due to simplicity and low cost, a popular nickel electroplating solution is known as the Watts solution. An example of a Watts solution that may be used in an embodiment includes the following composition ranges:

Nickel sulphate, $NiSO_46H_2O$: 20-40 oz/gal

Nickel chloride, $NiCl_26H_2O$: 4-20 oz/gal

Boric acid, $H_3BO_3$: 4-7 oz/gal

Agents such as paratoluene sulfonamide, benzene sulphonic acid can be added in concentration of 0.1-3 oz/gal (0.75-23 g/l) to achieve a leveling effect in an embodiment. These agents contain sulfur, and provide for a uniform plating. Agents such as formaldehyde chloral hydrate and allyl sulfonic acid can be added in concentration of 0.0006-0.02 oz/gal (0.0045-0.15 g/l) to achieve a leveling effect in an embodiment. These agents are secondary brightners, and produce in combination with other agents, a very smooth surface. Other agents such as sodium allyl sulfonate and pyridinum propyl sulfonate can be added to the solution in concentration of 0.01-0.5 oz/gal (0.075-3.8 g/l) to achieve a leveling effect in an embodiment.

The second layer, or the sulfumate nickel layer 320B, of the underplate is made up of 40 micro-inches of standard sulfumate nickel in an embodiment. In other embodiments, the sulfumate nickel layer 320B has a thickness between 5-150 microinches. Sulfumate nickel is very hard, and represents an inexpensive way to add strength and average corrosion resistance to the contact at a relatively low stress level. The porosity of the sulfumate nickel is mitigated by the leveling nickel layer, avoiding the main weakness of the traditional single-layer underplate.

The third layer of the underplate, or the high-phosphorous nickel layer 320C, is made up of 20 micro-inches of high-phosphorous nickel in an embodiment. In other embodiments, the high-phosphorous nickel layer 320C has a thickness between 5-100 microinches. As used herein, high-phosphorous nickel means any nickel that contains at least 4.5% phosphorous. However, high-phosphorous nickel does not commonly exceed 15% phosphorous. High-phosphorous nickel is one of the least corrosive of all nickel compounds, and acts as a sealer for the other layers.

In an embodiment, only the contact portion 210 of contact 200 is expected to come into contact with other contacts. Therefore, other plating materials or material quantities may be used on other portions of contact 200. For example, contact portion 210 includes a surface plate of 30 microinches or more of gold in an embodiment. Other portions, also described herein as non-contact portions, of contact may only have a thinner coating of gold applied, because gold is expensive, and non-contact portions of contact 200 are unlikely to achieve any additional advantage by having a thicker layer of gold plating.

Test Results

To prove the corrosion resistance properties of the multi-layer nickel underplating, multiple embodiments were tested. The following equipment was used:

Potentiostat: Gamry PCI4/300 with Framework/DC105 software

Reference Electrode: Saturated calomel electrode (SCE)

Auxillary Electrode: Graphite rod

Tempurature Control: Temperature-controlled hot plate and water bath

Reagents included a) Water: Reagent grade distilled, deionized water; ASTM D 1193, Type II; and b) Test solution: Phosphate-buffered saline (PBS) per ASTM F2129-08. Sigma-Aldritch. For preparation, all 5 pins of a micro-USB connector were shorted together on the solder side and connected to the test lead. Silicone sealant was used to cover all exposed metal surfaces except the pin mating ends.

For each of the following tests, a USB connector was submerged in the solution, and the open-circuit potential was measured for five minutes before the application of 0.7V versus the SCE. A measurement of electrical current was taken every 5 seconds. The test was performed at room temperature.

A first test was performed on a connector with contacts having a copper substrate, where the contact area of the copper substrate was plated with a 80 microinch sulfumate nickel plating, which was in turn plated with 30 microinches of gold.

A second test was performed on a connector with contacts having a copper substrate, where the contact area of the copper substrate was plated with a multi-layer nickel underplating. The multi-layer nickel underplating was plated with 30 microinches of gold. The multi-layer nickel underplating that was used in the second test included 40 microinches of leveling nickel plating, 40 microinches of sulfumate nickel plating, and 20 microinches of high-phosphorous nickel plating.

A third test was performed on a connector with contacts having a copper substrate, where the contact area of the copper substrate was plated with a multi-layer nickel underplating. The multi-layer nickel underplating was plated with 30 microinches of gold. The multi-layer nickel underplating that was used in the third test included 80 microinches of leveling nickel plating, 40 microinches of sulfumate nickel plating, and 40 microinches of high-phosphorous nickel plating.

Figure 5:
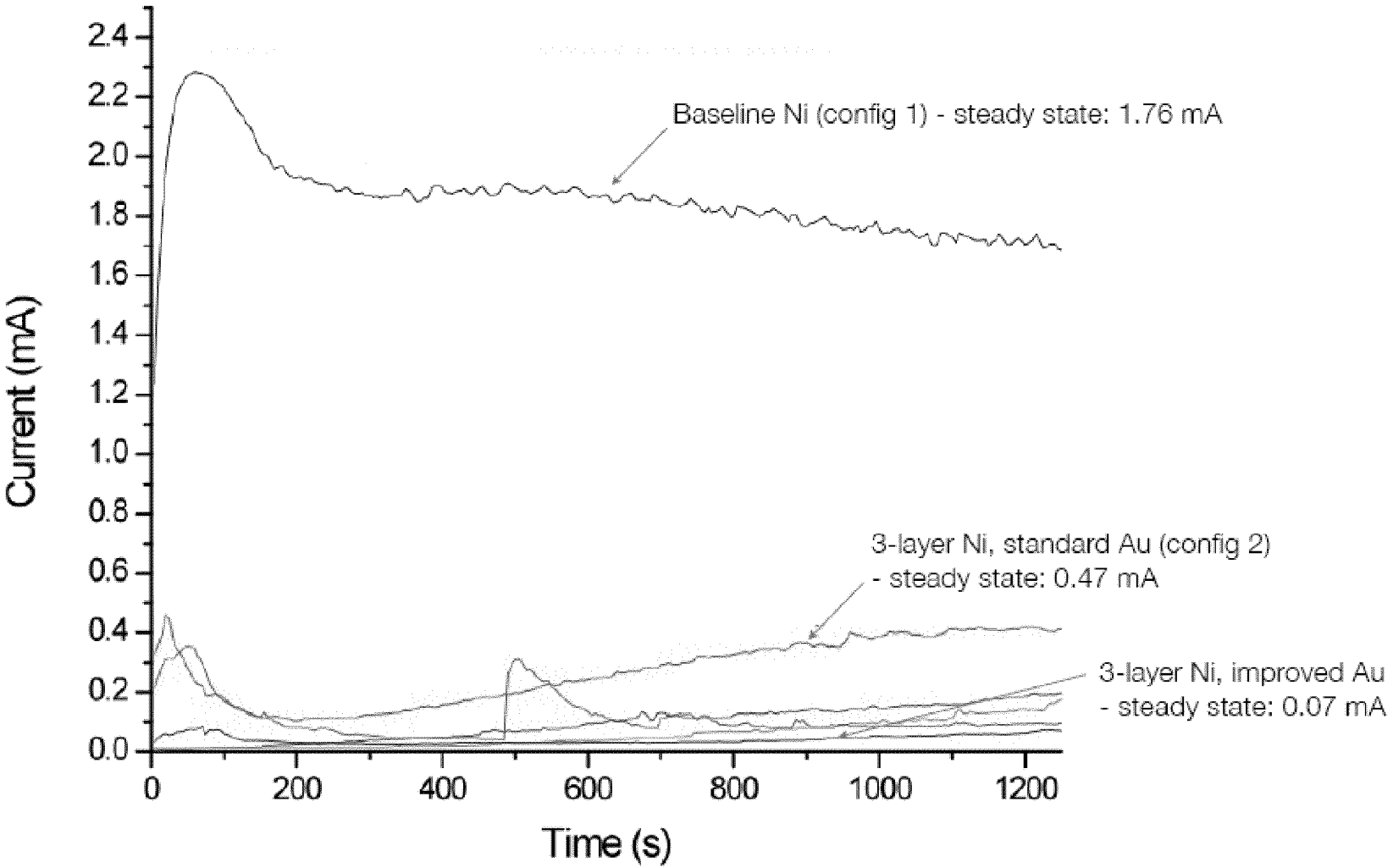
FIG. 5 is a chart that illustrates a comparison between the corrosion rate of a traditional connector and a connector using a multi-layer nickel underplate in an embodiment.

The results of the tests are charted in FIG. 5, which illustrates a comparison between the corrosion rate of a traditional connector and the two connectors using a multi-layer nickel underplate in an embodiment. The traditional connector used in the first test is identified in FIG. 5 as "Baseline Ni (config 1)". The embodiment used in the second test is identified as "3-layer Ni, standard Au (config 2)". The embodiment used in the third test is identified as "3-layer Ni, improved Au."

It is evident from the chart in FIG. 5 that both of the embodiments that included a multi-layer nickel underplating greatly outperformed the traditional connector that did not have the multi-layer nickel underplating. The corrosion measurements of the embodiments that included a multi-layer nickel underplating were an order of magnitude lower than that of the traditional connector. In summary, it has been shown that contacts for electrical connectors having a multi-layer nickel underplating of leveling nickel, sulfumate nickel, and high-phosphorous nickel present far superior resistance to corrosion as compared to contacts that only have a single layer of sulfumate nickel.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical connector, comprising:

a body; and a plurality of contacts carried by the body, wherein each of the plurality of contacts includes a multi-layer nickel underplate formed over a contact portion of an electrically conductive substrate, the multi-layer nickel underplate comprising: a leveling nickel plating, a sulfumate nickel plating applied over the leveling nickel plating, and a high-phosphorous nickel plating applied over the sulfumate nickel plating.

2. The electrical connector set forth in claim 1 wherein each of the plurality of contacts further comprises a corrosion-resistant, electrically-conductive coating applied over the high-phosphorous nickel plating.

3. The electrical connector set forth in claim 2 wherein the substrate is a copper substrate and the corrosion-resistant, electrically-conductive coating is gold.

4. The electrical connector set forth in claim 3 wherein the multi-layer nickel underplate consists of three layers including a leveling nickel plating, a sulfumate nickel plating formed directly on the leveling nickel plating, and a high-phosphorous nickel plating formed directly on the sulfumate nickel plating.

5. The electrical connector set forth in claim 4 wherein the leveling nickel plating is formed directly on the copper substrate and the gold coating is formed directly on the high-phosphorus nickel plating.

6. The electrical connector set forth in claim 5 wherein, in the contact portion, the leveling nickel plating is between 20 and 60 microinches thick, the sulfumate nickel plating has a thickness of between 80-120 percent of the leveling nickel plating, and the high-phosphorous nickel plating has a thickness between 25-100 percent of the leveling nickel plating.

7. The electrical connector set forth in claim 6 wherein a surface roughness of the leveling nickel plating is between 2-50 percent of a surface roughness of the copper substrate.

* * * * *